US008152588B2

(12) United States Patent
Hua

(10) Patent No.: US 8,152,588 B2
(45) Date of Patent: Apr. 10, 2012

(54) BALLOON HOLDER FOR HELIUM AND AIR-FILLED BALLOONS

(76) Inventor: Adam Hua, Arcadia, CA (US)

( * ) Notice: Subject to any disclaimer, the term of this patent is extended or adjusted under 35 U.S.C. 154(b) by 247 days.

(21) Appl. No.: 12/752,990

(22) Filed: Apr. 1, 2010

(65) Prior Publication Data

US 2011/0240823 A1 Oct. 6, 2011

(51) Int. Cl.
*A63H 3/06* (2006.01)
*A63H 3/00* (2006.01)

(52) U.S. Cl. ..... 446/220; 446/223

(58) Field of Classification Search ..... 446/220–226; 40/212, 214, 412; 248/309.1
See application file for complete search history.

(56) References Cited

U.S. PATENT DOCUMENTS 4,589,854 A * 5/1986 Smith ..... 446/223
4,895,545 A * 1/1990 Nelson ..... 446/220
5,021,022 A * 6/1991 Ganz ..... 446/220
5,203,530 A * 4/1993 Liu ..... 248/309.1
5,444,607 A * 8/1995 Dreyfuss ..... 362/352
5,944,576 A * 8/1999 Nelson et al. ..... 446/220
6,375,534 B1 * 4/2002 Burns ..... 446/220
6,969,295 B1 * 11/2005 Sidwell ..... 446/220
2007/0049158 A1 * 3/2007 Chou ..... 446/220

* cited by examiner

*Primary Examiner* — Kien Nguyen
(74) *Attorney, Agent, or Firm* — Jennifer Riel; Riel Law

(57) ABSTRACT

A balloon holder for helium and air-filled balloons comprises: a base with adequate mass to hold down at least one helium balloon; a housing surrounding the base; a loop member comprised of a sunken portion submerged inside the base and a loop above the base wherein the loop fastens to a line attached to a helium balloon; and a stem comprised of a lower end submerged inside the base and a top end above the base wherein the top end is adapted to receive a balloon cup attached to an air-filled balloon. The loop member may be comprised of a metal wire, and the loop may secure one or multiple helium balloons. The balloon holder may also include a platform on top of the base that includes a central aperture through which the stem passes through and at least one additional aperture through which the loop member passes through.

20 Claims, 11 Drawing Sheets

BALLOON HOLDER FOR HELIUM AND AIR-FILLED BALLOONS

FIELD OF THE INVENTION

The present invention generally relates to balloon holding devices. More particularly, the present invention relates to a balloon holding device that secures helium and air-filled balloons and also functions as a decorative centerpiece.

BACKGROUND

Balloons made of rubber, latex, Mylar®, or other suitable material have long been filled with air and used as gifts, decorations, or toys. They are often made of reflective or colorful material, and are often imprinted with designs, depictions of characters, or slogans such as "Happy Birthday!" They are common at birthday parties, graduations, and other festive events.

Balloons may be filled by normal atmospheric air (from a pump or from a person blowing into the balloon to inflate it), and are known as "air-filled balloons." However, balloons are sometimes inflated with helium, which is lighter than the surrounding air and causes the balloons to rise, or float if tethered. These buoyant helium balloons are customarily fixed by the balloon retailer with a line such as a string, ribbon, or some kind of a decorative cord so that they may be held (to prevent them from floating away), and they are commonly secured by tying the line to a heavy or stationary object or to balloon weights currently sold on the market. Such balloon weights are structured for use with only helium balloons, so if a consumer wants to also secure and display an air-filled balloon (which is filled with non-helium gases and is not buoyant), the consumer would normally have to utilize a separate balloon holding device made specifically for air-filled balloons. Air-filled balloons, particularly reflective Mylar® balloons, are often fixed by the retailer with a balloon cup and stick apparatus instead of with a line or cord.

The holding devices for air-filled balloons are also limited since they can only be used with air-filled balloons. For instance, air-filled balloons are usually held and displayed by a plastic funnel-shaped balloon cup and stick apparatus. The air-filled balloon is attached directly onto a balloon cup, and the balloon cup is attached to the tip of a stick. Inflated air-filled balloons sold to consumers are usually sold with the air-filled balloon already attached to the balloon cup and stick apparatus. However, the balloon cup and stick apparatus alone cannot also function to secure helium balloons since a balloon cup and stick apparatus does not provide enough mass to hold down one or more helium balloons.

Other air-filled balloon holding devices also function as a decorative centerpiece, but they also lack the necessary mass to hold down one or more helium balloons and lack structures to which a helium balloon line can be securely attached to. If helium balloons are to form part of a centerpiece for placement on a dining table or any other display, then the helium balloons should be securely held down in a decorative and aesthetically pleasing method which is not possible with the available centerpiece devices that hold only air-filled balloons.

Furthermore, air-filled balloon devices that also function as a centerpiece may also be too specialized as they are adapted for use with specific air-filled balloons that are packaged in a deflated state and sold together with the specialized holder ("prepackaged balloons"). These prepackaged balloons are not usually sold separately from its specialized holder. A potential drawback is that the user may not want to use the prepackaged balloon sold with the specialized holder and may prefer to use another air-filled balloon (e.g., one for a particular occasion) that are commonly sold in any party supply store, greeting card store, toy store, gift store, or even a grocery store. In such instances, the user may be deterred from using a preferred air-filled balloon with such specialized devices since these devices are structured and adapted to hold their specific prepackaged balloons, and it may seem like a waste of money for the user to have to purchase an additional balloon when the user has already paid for the prepackaged balloon. Additionally, these prepackaged balloons are limited in selection since they usually contain images of licensed cartoon characters which may not appeal to everyone, especially adults.

If the user decides to use the prepackaged balloon, then the user has an additional burden of having to inflate the balloon himself and having to figure out how to attach and assemble the inflated balloon onto the specialized holding device. The specialized holding device contains non-universal structures that hold the air-filled balloons as these structures may only be used with the specialized holding device. Also, such holding devices may employ non-reusable components to help secure the air-filled balloon such as adhesives or adhesive tapes that do not allow the device to easily be disassembled, stored, and reused, and do not allow the air-filled balloon to easily be interchanged with different varieties if the user changes his mind or if the user wants to later reuse the holding device with a different air-filled balloon.

Accordingly, there is a need in the art for a multifunctional, versatile, universal, interchangeable, reusable, simple to use, and aesthetically pleasing balloon holding device that secures both helium balloons and air-filled balloons; does not require specialized air-filled balloons; allows the user to select virtually any balloon commonly sold in any market; allows the user to easily interchange the balloons; and allows users to easily disassemble, store, and reuse the holding device. A balloon holding device that addresses all of the above-mentioned drawbacks in the art would not only provide a consumer with a wide array of balloon displaying options, but it would certainly be more cost-efficient since a separate holding device would not have to be purchased if securing and displaying both helium and air-filled balloons, the components of the device would be universal allowing it to be used with practically any balloon on the market, the device is reusable since it is easily collapsible, and different balloons may easily be interchanged for different occasions. Other advantages of the present invention will be apparent to one of ordinary skill in the art in light of the ensuing description of the present invention.

SUMMARY

The present invention is directed to a balloon holding device that secures and displays both helium balloons and air-filled balloons while also functioning as a decorative centerpiece. The device of the present invention does not require specialized air-filled balloons as the user may select virtually any balloon commonly sold on the market for use with the balloon holding device. The user can easily interchange the balloons with different varieties since the device does not employ permanent holding methods such as adhesives, and the user can easily disassemble, store, and reuse the balloon holding device. The present invention is multifunctional, versatile, universal, interchangeable, reusable, and simple to use while being decorative and aesthetically pleasing.

To achieve the foregoing and in accordance with the purposes of the present invention, the present invention is directed to a balloon holder for helium and air-filled balloons that comprises: (a) a base with adequate mass to hold down at least one helium balloon; (b) a housing surrounding the base; (c) a loop member comprised of a sunken portion submerged inside the base and a loop above the base; and (d) a stem comprised of a lower end submerged inside the base and a top end above the base. The loop fastens to a line attached to a helium balloon, and the top end of the stem is adapted to receive a balloon cup that is attached to an air-filled balloon. The balloon cup is removably attachable to the top end to allow the user to interchange the air-filled balloon. In some embodiments, the balloon holder may further include a platform on top of the base. This platform includes a central aperture and at least one additional aperture wherein the stem passes through the central aperture and the loop member passes through the at least one aperture. The loop member may be comprised of a wire, and the sunken portion of the loop member may be comprised of a first end and a second end wherein the first end is attached to the second end. In such embodiments, the balloon holder may further comprise a platform on top of the base that includes a central aperture, a first aperture, and a second aperture wherein the stem passes through the central aperture, the first end passes through the first aperture, and the second end passes through the second aperture. In another embodiment, the housing includes an opening on top of the housing, and the housing is taller than the base thereby forming a cavity above the base wherein the loop and the top end of the stem are accessible through the opening. In another variation of the invention, the housing is about the same height as the base, and the housing includes a housing top (that covers the top of the base) comprised of a central aperture and at least one additional aperture wherein the stem runs through the central aperture and the loop member runs through the at least one additional aperture.

In an additional embodiment of the present invention, a balloon holder for helium and air-filled balloons comprises: (a) a base with adequate mass to hold down at least one helium balloon; (b) a housing that is taller than the base and surrounds the base to form a cavity above the base wherein the housing includes an opening above the cavity and a bottom beneath the base; (c) a loop member that includes a sunken portion submerged inside the base and a loop positioned above the base wherein the loop fastens to a line attached to a helium balloon; (d) a stem that includes a lower end submerged inside the base and a top end positioned above the base wherein the top end is adapted to secure an air-filled balloon, and (e) a platform on top of the base. The platform includes a center aperture and at least one additional aperture wherein the stem passes through the center aperture and the loop member passes through the at least one additional aperture. The loop that secures one or more helium balloons and the top end that secures an air-filled balloon are accessible through the housing's opening which is positioned above the cavity.

In such embodiments of the invention, the top end of the stem further includes a balloon cup that attaches directly to an air-filled balloon. This balloon cup is removably attachable to the top end of the stem to allow a user to interchange different air-filled balloons. The loop member may be comprised of a wire, and the sunken portion of the loop member may be comprised of a first end and a second end wherein the first end is attached to the second end. For example, the first end and the second end may be attached to each other simply by tying or twist-tying the first end with the second end. For variations of the invention wherein the sunken portion of the loop member is comprised of a first end and a second end, the at least one additional aperture of the platform is comprised of a first aperture and a second aperture wherein the first end passes through the first aperture and the second end passes through the second aperture. The platform may further include one or more downward projections that anchors the platform onto the base. The base may be comprised of any suitable material that provides adequate mass to hold down one or more helium balloons such as sand, cement, clay, sedimentary rocks, metal, water, or combinations thereof. Additionally, the housing may be comprised of any variety of shapes. For example, in one embodiment, the housing may be cylindrical in shape and the opening and the bottom of the housing may be circular in shape. The balloon holder of the present invention may include a variety of decorative elements attached to the housing. For instance, in one variation of the invention, multiple tiers of cascading streamers are attached to the exterior of the housing wherein the loop (that is attached to a line of helium balloon) is recessed within the highest tier of the multiple tiers of cascading streamers. This features allows the loop to be hidden and provides an aesthetically pleasing quality.

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects, and advantages of the present invention will become apparent from the following description of the invention, taken in conjunction with the accompanying drawings, which illustrate, by way of example, various features of embodiments of the invention.

DESCRIPTION OF THE INVENTION

In the following description of embodiments of the invention, reference is made to the accompanying drawings, which form a part of this application. The drawings show, by way of illustration, certain embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

Exterior of Balloon Holding Device

Figure 1:
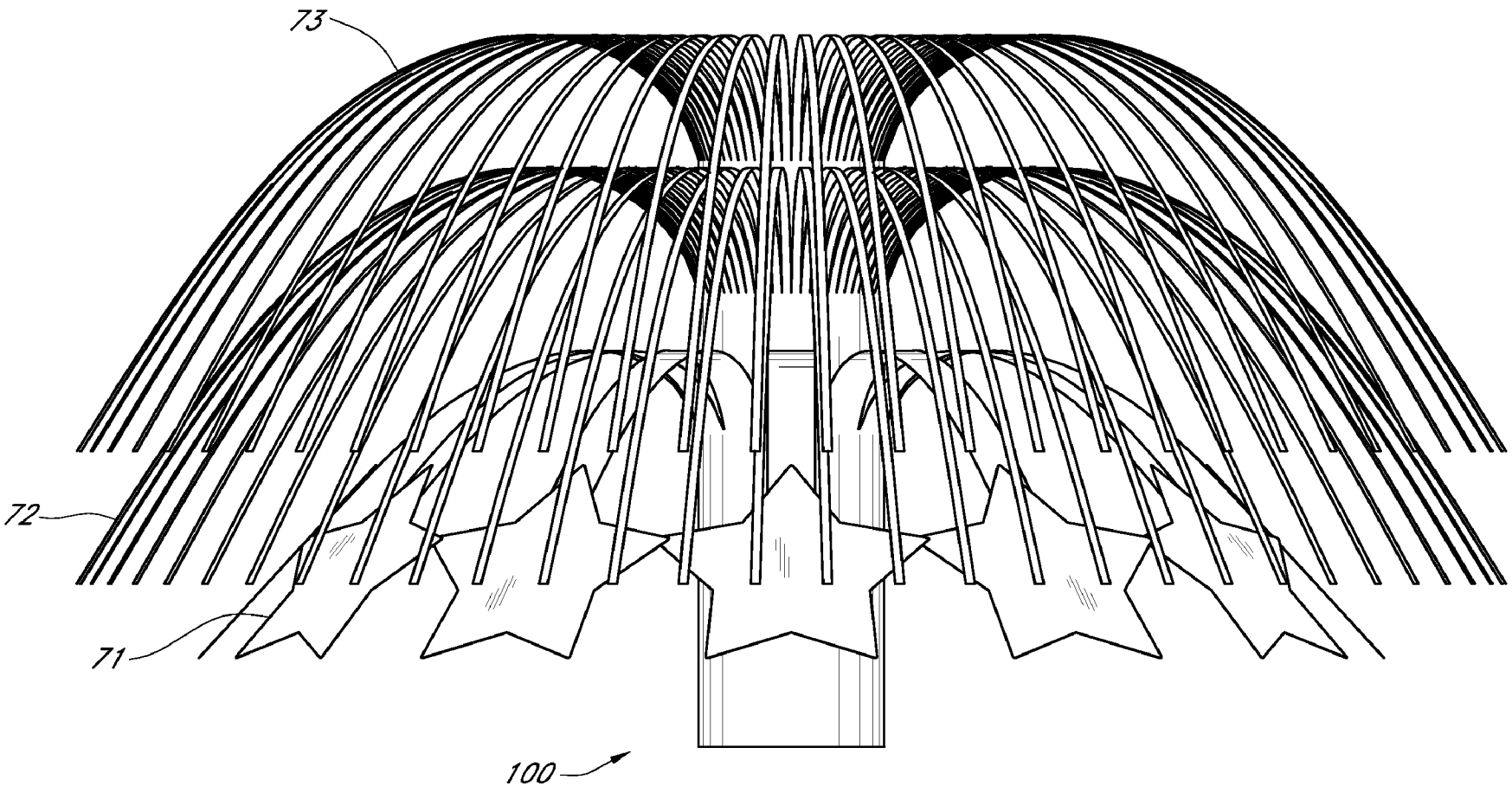
FIG. 1 depicts a perspective view of a balloon holder in accordance with an embodiment of the present invention.

FIG. 1 depicts a perspective view of one embodiment of the balloon holder for helium and air-filled balloons of the present invention. Balloon holder 100 refers to the apparatus that contains the structures that secure and display helium and air-filled balloons. Balloon holder 100 may further include a variety of decorative elements attached thereto. For example, as seen in FIG. 1, the decorative elements are comprised of multiple tiers of cascading streamers that include a bottom tier 71, a middle tier 72, and a top tier 73. Of course in alternate embodiments, there may be only one tier, two tiers, or four or more tiers of cascading streamers. These streamers may be of any suitable shape, size, dimension, material, color, and quantity. For instance, bottom tier 71 includes a plurality of streamers with star-shaped adornments at the end of each streamer. The streamers of bottom tier 71 are less in quantity and are wider in size than the streamers that comprise middle tier 72 and top tier 73. Any of the streamers or decorative elements attached to balloon holder 100 may further include or alternatively include different shapes (e.g., hearts, graduation hats, crosses, circles, animals, flowers, shamrocks), symbols, adornments, ornaments, charms, lettering and messages (e.g., "Happy Birthday," "Congratulations," or "It's a Boy"), depictions of characters, etc. in any suitable configuration and dimension.

Figure 2:
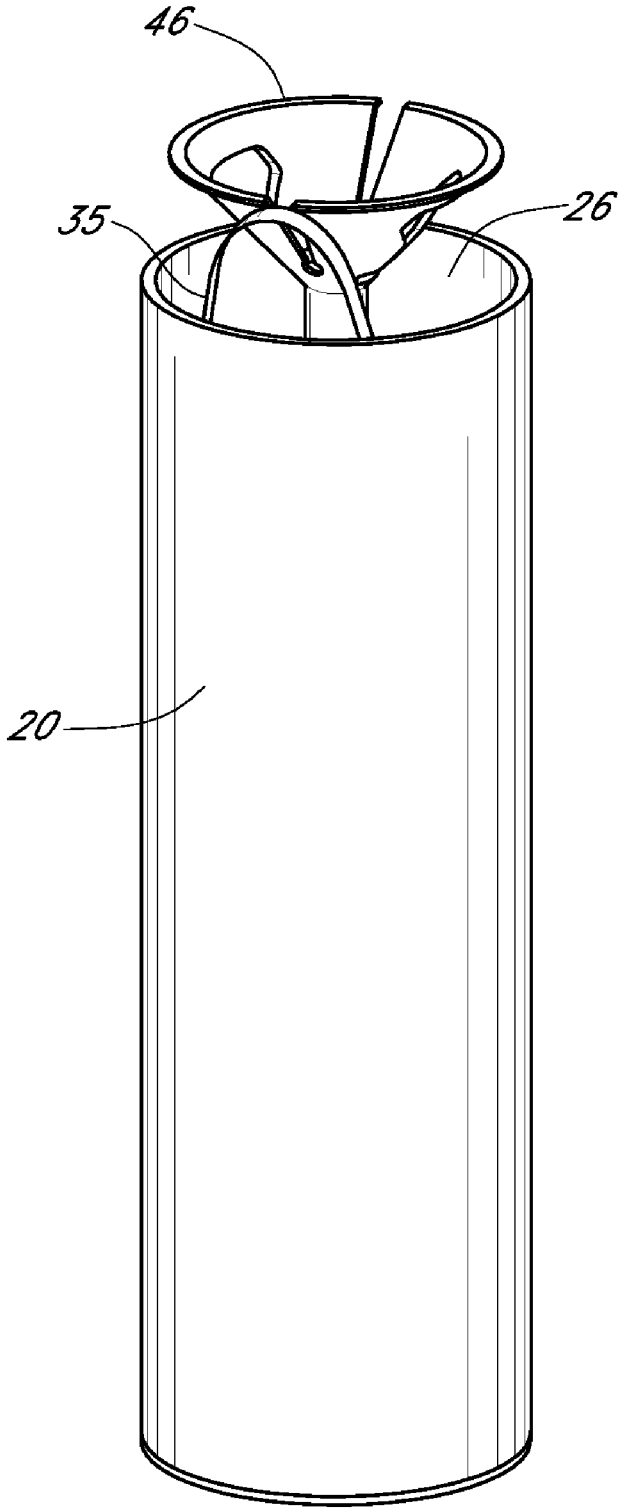
FIG. 2 depicts a perspective view of the housing of a balloon holder in accordance with an embodiment of the present invention.
Figure 3:
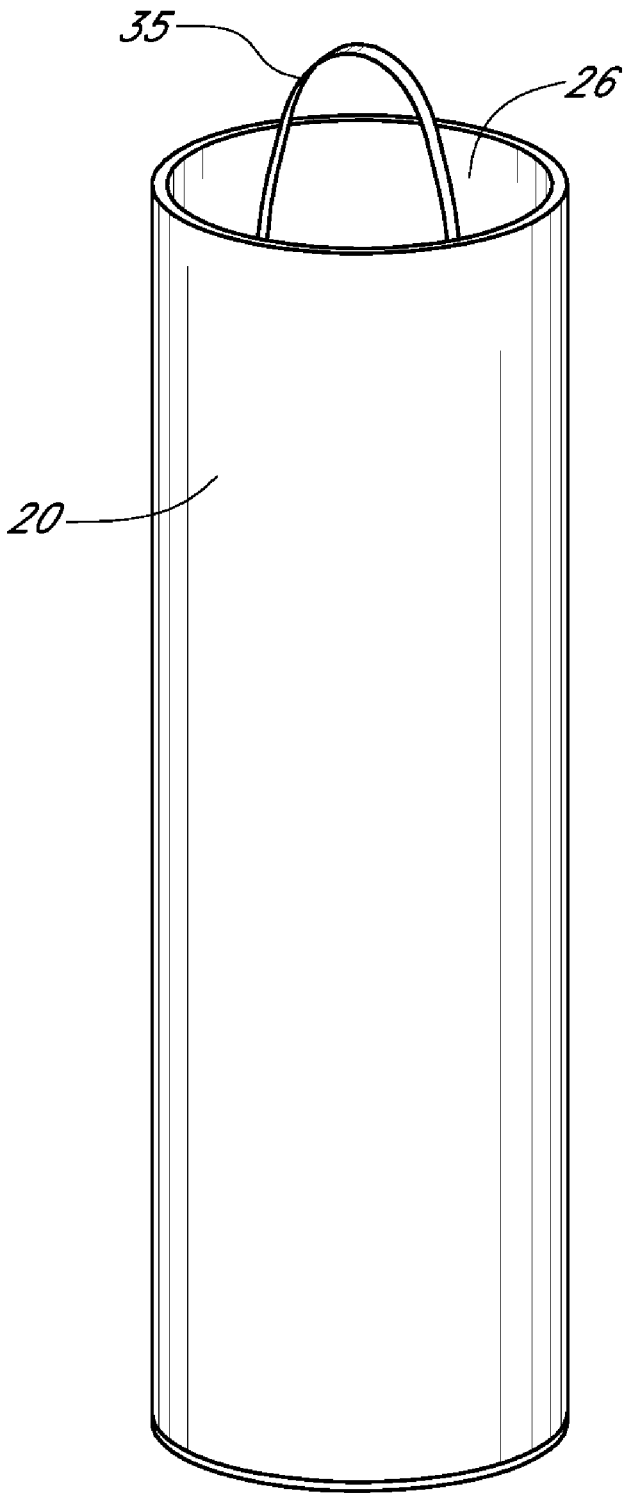
FIG. 3 depicts a perspective view of the housing of a balloon holder in accordance with an embodiment of the present invention.

FIGS. 2 and 3 illustrate balloon holder 100 with no decorative elements attached thereto and depicts a perspective view the exterior of a housing 20 that makes up the exterior casing or shell of balloon holder 100. As seen in FIGS. 2 and 3, housing 20 includes an opening 26 on top of balloon holder 100. Opening 26 allows the user access to the structures that secure the helium and air-filled balloons. The embodiment of the invention shown in FIG. 2 includes a balloon cup 46 and a loop 35. Balloon cup 46 attaches directly to and secures an air-filled balloon. Loop 35 fastens to a line attached to a helium balloon, and this can be accomplished simply by tying the line of the helium balloon onto loop 35. Loop 35 may accommodate and secure one or a plurality of lines attached to one or multiple helium balloons. FIG. 3 shows an embodiment of the invention which includes loop 35 to secure one or more helium balloons but does not include balloon cup 46. However, such embodiments that do not include balloon cup 46 may include structures adapted for use with balloon cup 46 as discussed in more detail below.

Balloon Holding Device Components

Figure 4:
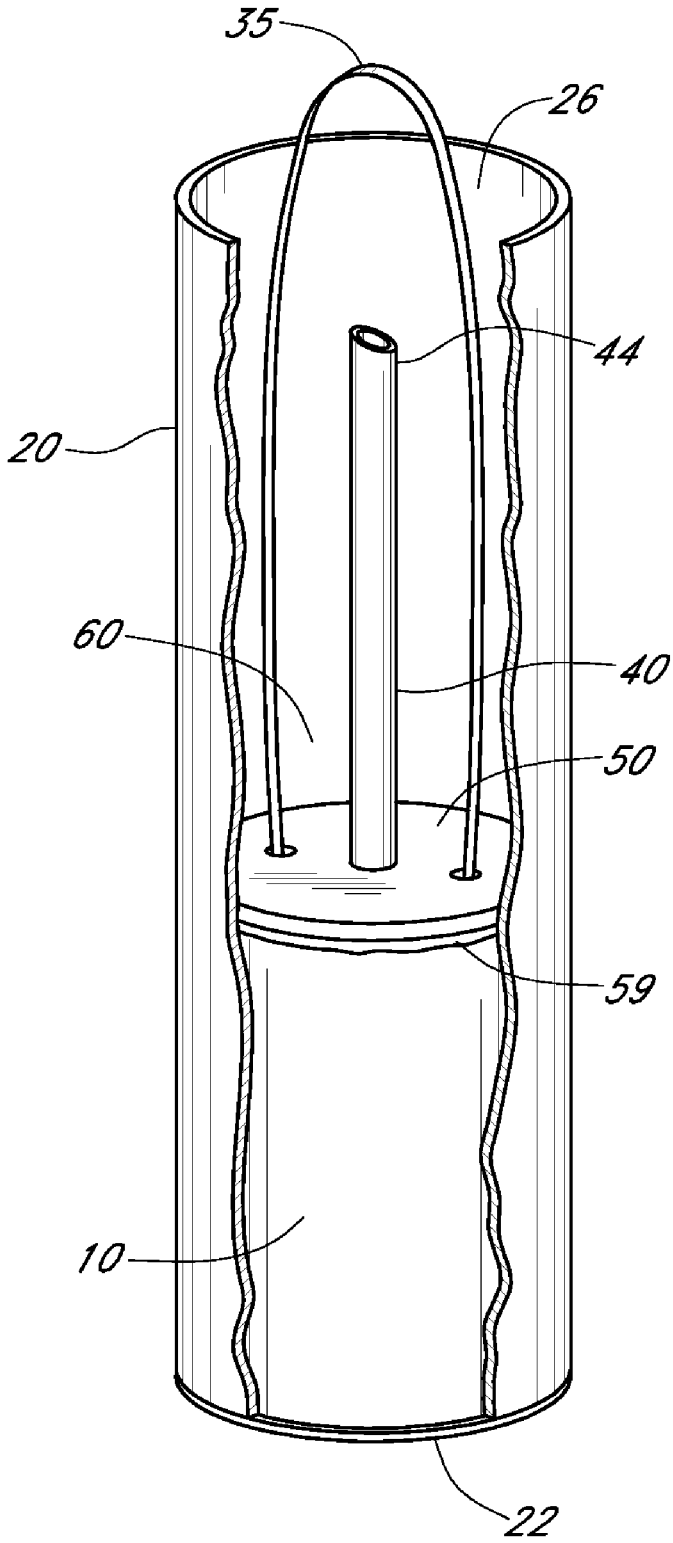
FIG. 4 depicts a cut-away view of a balloon holder shown in FIG. 3 in accordance with an embodiment of the present invention.

FIG. 4 depicts a cut-away view or cross-sectional view of balloon holder 100 shown in FIG. 3 and illustrates the basic components of balloon holder 100 in accordance with one embodiment of the present invention. As shown in FIG. 4, balloon holder 100 comprises: (a) a base 10 with adequate mass to hold down at least one helium balloon; (b) a housing 20 that is taller than base 10 and surrounds base 10 to form a cavity 60 above base 10; (c) a loop member that includes a sunken portion 33 (see FIG. 5) that is submerged inside base 10 and a loop 35 positioned above base 10; (d) a stem 40 that includes a lower end 42 (see FIG. 5) that is submerged inside base 10 and a top end 44 positioned above base 10; and (e) a platform 50 on top of base 10. Although platform 50 may be attached to the top of base 10 in a variety of ways, FIG. 4 shows platform 50 attached to base 10 by a layer of glue 59. Housing 20 includes an opening 26 above cavity 60 and a bottom 22 beneath base 10. Loop 35 can fasten to one or more lines attached to one or a plurality of helium balloons. Top end 44 of stem 40 is adapted to secure an air-filled balloon. In some embodiments of the invention, top end 44 may further include a balloon cup 46 (as shown in FIG. 2) that attaches directly to an air-filled balloon wherein balloon cup 46 is removably attachable to top end 44.

Figure 5:
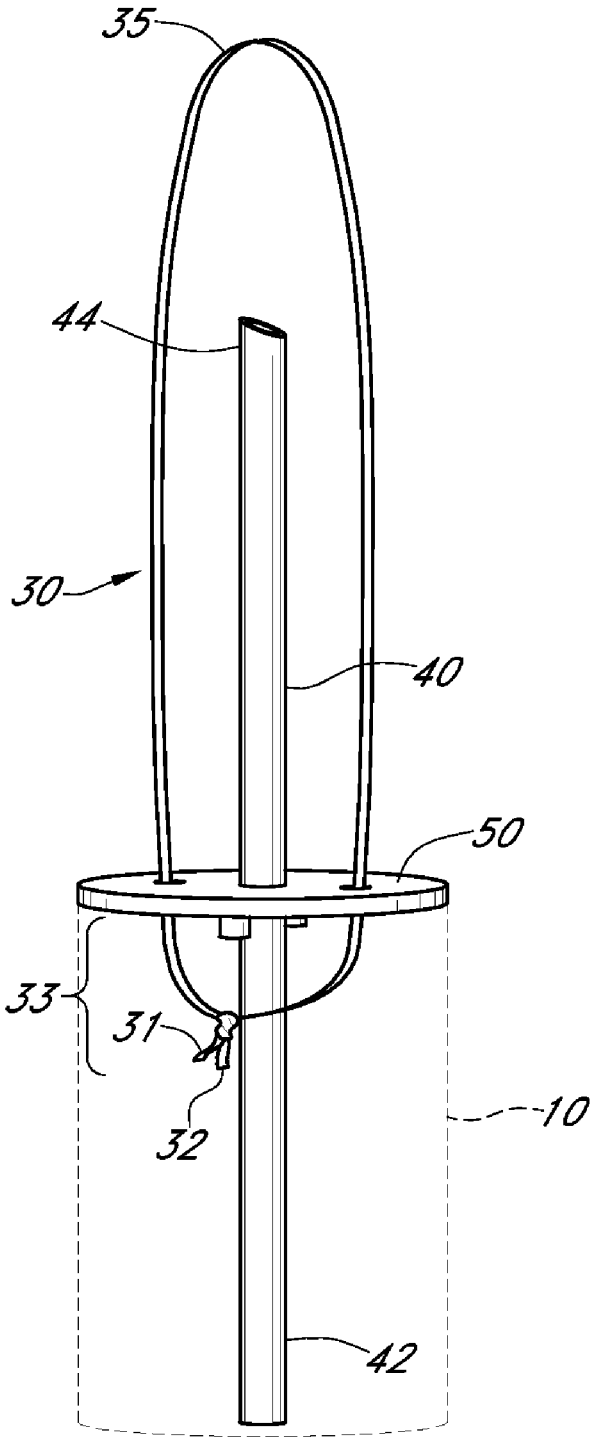
FIG. 5 depicts a perspective view of the loop member and stem assembly of the balloon holder shown in FIG. 4 in accordance with an embodiment of the present invention.
Figure 8:
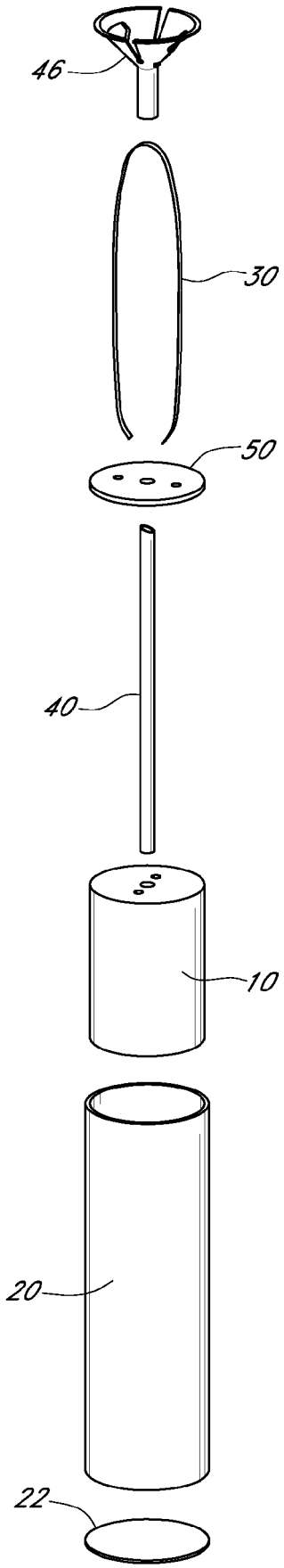
FIG. 8 depicts an exploded view of the balloon holder shown in FIG. 4 in accordance with an embodiment of the present invention.

FIG. 8 illustrates an exploded view of balloon holder 100 shown in FIG. 4. As seen in FIG. 8, balloon holder 100 is comprised of: (a) base 10 that has adequate mass to hold down at least one helium balloon and is positioned within the bottom area of balloon holder 100; (b) housing 20 that includes bottom 22 that lies beneath base 10; (c) loop member 30 that secures one or more helium balloons; (d) stem 40 that secures an air-filled balloon; and (e) platform 50 that is positioned on top of base 10. When balloon holder 100 is assembled, housing 20 not only surrounds base 10 but also surrounds loop member 30, stem 40, and platform 50; and sections of loop member 30 and stem 40 (i.e., sunken portion 33 of loop member 30 and lower end 42 of stem 40) are submerged within base 10 as depicted in FIG. 5 and described in more detail below.

Base

Base 10 may be comprised of any material that provides enough mass to stabilize balloon holder 100 and enough mass to hold down at least one helium balloon. Although "at least one helium balloon" is the minimum mass requirement of base 10, preferred embodiments of the invention will have enough mass to hold down multiple helium balloons. Accordingly, base 10 may be comprised of anything that provides enough heaviness such as cement, sand, clay, sedimentary rocks, gravel, shale, water, metal components, any suitably heavy material known to one skilled in the art, or combinations thereof. Such combinations may include water, glue, and/or other types of adhesives. By way of example, base 10 may be comprised of cement, loose sand, sand held together by adhesive, a combination of compressed sand and adhesive, loose sedimentary rocks, sedimentary rocks held together with an adhesive, or a mixture of cement, sand, and water. Yet, in other embodiments, base 10 may be comprised of a piece or block of metal or may be comprised of a plurality of metal components such as metal lead shot or buckshot (or other sufficiently heavy small metal balls, beads, or components) which does not need to be held together with adhesive so long as housing 20 can securely encase the contents of base 10.

In other embodiments of the present invention, base 10 may be watertight (and/or a section of housing 20 that encases base 10 may be watertight), and may be filled with varying amounts of water to provide suitable weight, and then emptied to allow for lighter weight and easier portability when not in use. In such embodiments, base 10 may then be emptied out by a detachable or openable bottom 22 of housing 20 or by a sealable or closeable hole in bottom 22 or in platform 50. Further embodiments of base 10 could include one or more detachable weights (made of metal or filled with suitably heavy material as discussed above) that attach to the bottom, sides, or inside of base 10 to allow for a customizable total apparatus weight suitable to the number and type of helium balloons being secured. Such weights could, for example, snap, slide, or attach onto the bottom of base 10 using a variety of attachment mechanisms known to those skilled in the art. These weights could be of varying sizes and weights, or multiple weights of the same size could be attached to achieve the desired total weight. Such embodiments that allow the addition of extra weight to base 10 may be ideal in scenarios (e.g., graduation ceremonies and weddings) that require large quantities of helium balloons to be secured and displayed.

Not only does base 10 need to be comprised of sufficiently heavy materials, but base 10 should also be able to securely hold sunken portion 33 of loop member 30 and lower end 42 of stem 40 since these structures are both submerged inside base 10 as illustrated in FIGS. 4 and 5. Thus, the embodiments in which base 10 is comprised of cement or of adhesive mixtures (e.g., clay, sand, and/or other sedimentary rock held together by adhesive) would provide the most stability to hold sunken portion 33 of loop member 30 and lower end 42 of stem 40 inside base 10 if sunken portion 33 and lower end 42 are set inside base 10 before such cement or adhesive mixture completely cures or dries. Thus, in such embodiments, sunken portion 33 of loop member 30 and lower end 42 of stem 40 are essentially permanently affixed and rooted into base 10 to prevent sunken portion 33 and lower end 42 from moving and destabilizing.

Although base 10 as depicted in FIGS. 4 and 8 is cylindrical in structure, any suitable variation in shape and dimensions are possible so long as base 10 has adequate mass to hold down one or more helium balloons. Base 10 does not necessarily need to take the shape of housing 20 since housing 20 merely surrounds base 10 but does not necessarily line the exterior of base 10. Examples of alternate shape variations of base 10 may include a cube, sphere, pyramid, rectangle, or any other shape. In one variation of the invention, base 10 may widen towards the bottom of balloon holder 100 to provide additional stability for balloon holder 100 and to resemble a shape similar to that of a vase.

Housing

In the embodiment of the invention shown in FIGS. 2-4 and 8, housing 20 is taller than base 10 and surrounds base 10 to form cavity 60 above base 10. Housing 20 includes an opening 26 above cavity 60 and a bottom 22 beneath base 10. Opening 26 provides the user access to loop member 30 and stem 40 to allow the user to secure and display helium and air-filled balloons. Opening 26 may be positioned at the top of housing 20 or at the top of the balloon holder of the present invention as shown in FIGS. 2-4, or opening 26 may alternatively be positioned anywhere within the present invention that provides the user adequate access to loop member 30 and stem 40 and allows helium and air-filled balloons to be displayed without obstruction. In alternate variations of the present invention, housing 20 does not include bottom 22 since in these variations, base 10 is comprised of cement or of adhesive mixtures (e.g., clay, sand, and/or other sedimentary rock held together by adhesive) and bottom 22 is thus not needed to hold the contents or materials of base 10 within balloon holder 100, although bottom 22 of housing 20 would protect such cement or of adhesive mixtures and provide an aesthetical quality. Alternatively, in variations of the invention wherein base 10 is comprised of loose sand, sedimentary rocks, gravel, shale, and/or metal components, bottom 22 is required to hold the contents of base 10 within balloon holder 100.

Bottom 22 may be manufactured along with housing 20 as one continuous unit made of the same material, or bottom 22 may be a separate component attachable to housing 20 and/or attachable to base 10. FIG. 8 illustrates a variation of the invention wherein bottom 22 is a separate component of housing 20 that is attachable to housing 20 and base 10. In such embodiments, bottom 22 may be made of the same material as housing 20 or of a different material. For example housing 20 may be comprised of a plastic or a sufficiently sturdy paper such as cardstock or cardboard. In one variation, housing 20 is comprised of plastic and bottom 22 is comprised of cardboard, and bottom 22 is attached to base 10 by glue or any other suitable methods. In other variations, both housing 20 and bottom 22 are comprised of plastic, both housing 20 and bottom 22 are comprised of cardboard, or housing 20 is comprised of cardboard and bottom 22 is comprised of plastic. Bottom 22 may also be made of a heavier material, such as metal, to help add weight to the structure.

In an alternate embodiment of the present invention, housing 20 is about the same height as base 10, and housing 20 includes a housing top that covers the top of base 10. Unlike in the embodiment of the invention shown in FIG. 4, there is no cavity 60 formed above base 10 and there is no platform 50 in these embodiments. The housing top essentially functions the same as platform 50 and is comprised of a central aperture through which stem 40 passes through and at least one additional aperture through which loop member 30 passes.

Although FIGS. 2-4 and 8 illustrate housing 20 as cylindrically-shaped with opening 26 and bottom 22 both circular in shape, housing 20 may be of any suitable size, shape, and dimension. For instance, in other variations of the invention, housing 20 may be comprised of a spherical, circular, pyramid, cube, rectangular, star, flower, or vase shape to name a few examples. Housing 20 may also be shaped to resemble an animal, cartoon character, a person's head, or any object.

Furthermore, as discussed above with reference to FIG. 1, balloon holder 100 may further include a variety of decorative elements. These decorative elements are actually attached to the exterior of housing 20. For example, as shown in FIG. 1, the decorative elements are attached to housing 20 and are comprised of multiple tiers of cascading streamers that include bottom tier 71, middle tier 72, and top tier 73, and in other variations of the invention, there may be only one tier, two tiers, or four or more tiers of cascading streamers. The decorative elements of the present invention may also function to hide some of the structures of balloon holder 100. For example, loop 35 and/or top end 44 of stem 40 may be recessed within the highest tier of the multiple tiers of cascading streamers. Also, balloon cup 46 (when attached to top end 44) may be partially or fully recessed within the highest tier of multiple tiers of cascading streamers. In the embodiment shown in FIG. 1, the highest tier would be top tier 73.

The streamers of bottom tier 71, middle tier 72, and top tier 73, as well as any other variety of decorative elements attached to housing 20, may be of any suitable shape, size, dimension, material, and quantity. In the variation of the invention shown in FIG. 1, bottom tier 71 includes a plurality of streamers with star-shaped adornments at the end of each streamer, and any of the streamers or decorative elements attached to housing 20 may further include or alternatively include different shapes (e.g., hearts, graduation hats, crosses or other religious symbols, circles, animals, flowers, shamrocks), symbols, adornments, ornaments, charms, lettering and messages, depictions of characters, etc. in any suitable configuration and dimension.

In other embodiments of the present invention, the decorative elements attached to housing 20 may simply be comprised of one or more sheets of decorative and festive paper which is taped and/or glued onto housing 20 with no streamers, ornaments, charms, or other adornments attached to the festive paper. However, in other variations of the invention, the festive paper may further include streamers, ornaments, charms, and/or other adornments attached thereto. In another embodiment, the decorative elements may simply comprise of any decorative paint applied directly onto housing 20. In variations of the invention wherein housing 20 is shaped as an animal or cartoon character, the decorative elements would comprise of the paint or ink that is used to designate the features of such animals or cartoon characters. Yet, in other embodiments of the invention, the decorative elements may comprise of various decorative finishes (e.g., glitter, powder coat textures, etc.) applied to the exterior of housing 20.

Loop Member

As depicted in FIG. 5, loop member 30 includes (i) sunken portion 33 that is submerged inside base 10 and (ii) loop 35 positioned above base 10. In embodiments of the invention in which housing 20 is taller than base 10 thereby forming cavity 60 above base 10 (see FIG. 4), loop 35 is essentially positioned within cavity 60. Loop 35 can fasten to one or more lines attached to one or a plurality of helium balloons. The lines of helium balloons may be fastened to loop 35 simply by tying the lines of the helium balloons onto loop 35.

As shown in FIGS. 4 and 5, loop member 30 is comprised of a metal wire. In the embodiments illustrated in FIGS. 4 and 5, the metal wire of loop member 30 is encased in a decorative foil-type material. This metal wire may also be encased in a thin strip of paper or plastic and is similar to that of a twist-tie commonly used to secure trash bags and sandwich bags. In fact, in certain embodiments of the present invention, a twist-tie may be used as loop member 30. The use of a metal wire for loop member 30 provides adjustability and flexibility to reposition loop 35 for easy user access, to recess loop 35 within cavity 60 to hide loop 35, or to widen or reconfigure loop 35 to allow additional lines of helium balloons to be easily tied onto loop 35. Thus, with a metal wire loop member 30, a user can easily pull up loop 35 from opening 26 of housing 20 for easier access to tie lines of helium balloons to loop 35 and then push loop 35 back down to recess loop 35 beneath opening 26 of housing 20 (see e.g., FIGS. 2-4) to hide loop 35. Alternatively, loop member 30 may be comprised of any suitable plastic (such as those used in cable ties) that is rigid enough to stand upright above base 10 and rigid enough to form loop 35.

In the embodiment of the invention shown in FIG. 5, sunken portion 33 of loop member 30 is comprised of a first end 31 and a second end 32 wherein first end 31 is attached to second end 32. First end 31 and second end 32 may be attached to each other simply by tying or twist-tying (in embodiments in which loop member 30 is comprised of a metal wire or of a twist-tie) first end 31 with second end 32. In other variations of the invention, first end 31 and second end 32 are not attached to each other and instead, a knot is tied at the ends of first end 31 and second end 32, first end 31 and second end 32 may be attached to lower end 42 of stem 40, or first end 31 and second end 32 are tied to another structure located within base 10. In embodiments of the invention wherein base 10 is comprised of cement or of an adhesive mixture (e.g., clay, sand, and/or other sedimentary rock held together by adhesive), first end 31 and second 32 do not necessarily need to be attached to each other, knotted at its ends, tied to lower end 42 of stem 40, or attached to any structures within base 10 since first end 31 and second end 32 may be securely held within base 10 if placed within base 10 before the cement or adhesive mixture is dried and cured during the manufacturing process. However, tying first end 31 with second end 32 before placement into base 10 is a relatively simple method to further secure and anchor sunken portion 33 of loop member 30 into base 10 and to properly position loop member 30 during the drying and curing process of base 10.

Figure 7:
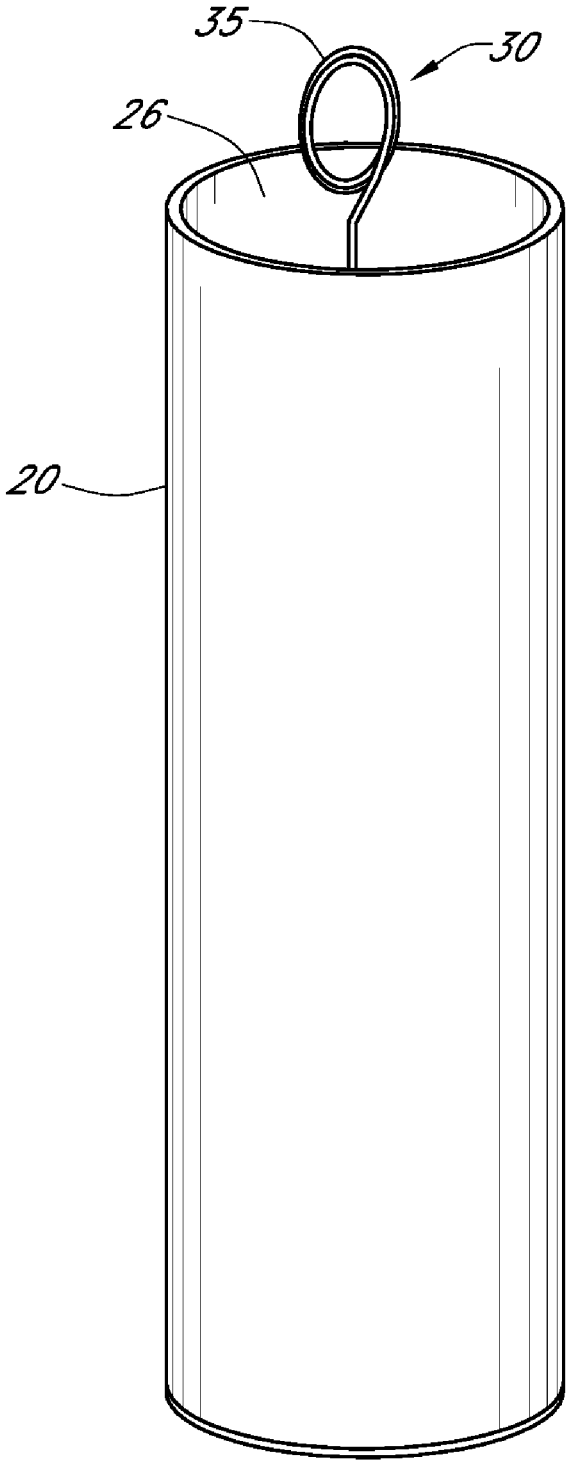
FIG. 7 depicts a perspective view of a balloon holder having an alternate loop member configuration in accordance with an embodiment of the present invention.

Unlike the embodiment of the invention illustrated in FIG. 5 wherein sunken portion 33 is comprised of two ends (i.e., first end 32 and second end 32), and loop 35 is shaped like an upside-down "U" or an arc (not a complete circle or oval) above base 10, FIG. 7 depicts an embodiment of the present invention that includes an alternate configuration for loop member 30. FIG. 7 shows a perspective view of the balloon holder of the present invention and illustrates an alternate configuration of loop member 30 surrounded by housing 20 wherein loop 35 is accessible via opening 26 of housing 20. In this configuration, sunken portion 33 of loop member 30 is comprised of only one end of loop member 30, and loop 35 is shaped as a circle or oval wherein loop member 30 is configured to form the complete circle or oval. In such embodiments, before base 10 is cured and dried, sunken portion 33 may be secured and anchored into base 10 by tying a knot at the end of sunken portion 33, by tying sunken portion 33 to lower end 44 of stem 40, or by tying sunken portion 33 onto platform 50 using one of the apertures of platform 50. In embodiments of the invention wherein base 10 is comprised of cement or of an adhesive mixture (e.g., clay, sand, and/or other sedimentary rock held together by adhesive), sunken portion 33 does not necessarily need to be knotted at its end, tied to lower end 42 of stem 40, or attached to any structures within base 10 since sunken portion 33 may be securely held within base 10 if placed within base 10 before the cement or adhesive mixture is dried and cured during the manufacturing process. However, tying at knot at the end of sunken portion 33 or tying sunken portion 33 to lower end 42 of stem 40 before placement into base 10 is a relatively simple method to further secure and anchor sunken portion 33 of loop member 30 into base 10 and to properly position loop member 30 during the drying and curing of base 10.

Although the shape of loop 35 may include an arch or may be configured as an upside-down "U" shape (see FIGS. 4 and 5) or an oval or circle (see FIG. 7), loop 35 may be comprised of alternate shapes since loop 35 does not necessarily need to have a "loop" shape. Loop 35 may essentially be shaped in any suitable manner so long as it can securely fastened to one or more lines attached to buoyant helium balloons. For example, in embodiments in which sunken portion 33 includes a first end 31 and second end 32 submerged within base 10, loop 35 may be configured into: a squared arch, a pointed arch, two pointed arches (forming an "M" shape), two round arches (forming a counter-clockwise 90-degree rotated "B"), or any other shape to which one or more helium balloon lines can be tied to. In embodiments in which sunken portion 33 is comprised of just one end submerged within base 10, loop 35 may be configured into a square, a triangle, a trapezoid, a star, or a rectangle to name a few examples. Furthermore, in embodiments in which loop member 30 is comprised of a metal wire, loop 35 may be nonpermanently configured in any of the above-mentioned shapes or any other shape and can be reconfigured to a different shape thereafter.

In an alternate embodiment of the present invention, loop member 30 includes loop 35 positioned above base 10 but does not include sunken portion 33 submerged inside base 10. In such embodiments, loop member 30 is attached to top end 44 of stem 40 or any area of stem 40 that lies above base 10. Loop member 30 may be attached to stem 40 by tying loop member 30 onto stem 40, by threading loop member 30 through one or more holes included on stem 40, gluing and/or clipping loop member 30 onto stem 40, or by any other suitable methods. Alternatively, loop member 30 may be attached to a designated structure on the surface of platform 50. In such embodiments, loop member 30 may be attached to stem 40 or platform 50 after base 10 is cured and dried.

Stem

As illustrated in FIG. 5, stem 40 includes lower end 42 that is submerged inside base 10 and a top end 44 positioned above base 10. Top end 44 of stem 40 is adapted to secure an air-filled balloon. For example top end 44 may include any structure to which an air filled balloon may be tied or attached to. In one embodiment of the present invention, top end 44 may be adapted to receive balloon cup 46 (see e.g., FIG. 2) that is attached to an air-filled balloon. Thus, stem 40 is configured and sized to that of a stick in a standard balloon cup and stick apparatus. Balloon cup 46 is removably attachable to top end 44 to allow the user to interchange the air-filled balloon. In some embodiments of the invention, top end 44 may further include balloon cup 46 that attaches directly to an air-filled balloon. Thus, depending on the embodiment of the invention, top end 44 may include any structure to which an air filled balloon may be tied or attached to, top end 44 may be adapted to receive balloon cup 46 but not include balloon cup 46 as part of balloon holder 100, or top end 44 may be adapted to receive balloon cup 46 and top end 44 may include balloon cup 46 as part of balloon holder 100.

As seen in FIG. 4, top end 44 is recessed within opening 26 at top of housing 20. The recession of top end 44 allows balloon cup 46 to also be recessed or partially recessed within opening 26 at top of housing 20 after balloon cup 46 is attached to top end 44, thereby providing an aesthetically pleasing feature.

Although one stem 40 is depicted in the accompanying figures, alternate embodiments of the invention may include additional stems to form a bouquet of air-filled balloons. Also, the stems do not necessarily need to be configured upright. In embodiments of the invention that include a plurality of stems to form air-filled balloon bouquets, the stems may be positioned at various angles in various configurations.

Platform

Some embodiments of the present invention include platform 50 that is positioned above base 10. In the embodiments in which housing 20 is about the same height as base 10 and housing 20 includes a housing top that covers the top of base 10, the balloon holder of the present invention does not include platform 50 or cavity 60 above base 10 since the housing top essentially has the same functions as platform 50. Other embodiments in which housing 20 is taller than base 10 and forms cavity 60 above base 10 may also not include platform 50.

Referring to FIGS. 4 and 5, platform 50 may act like a partition between base 10 and cavity 60, provides an aesthetically pleading stage from which loop member 30 and stem 40 pass through (instead of directly exposing the materials and contents of base 10), may assist in the guiding and proper placement of loop member 30 and stem 40 into base 10 and the proper shaping of base 10 before base 10 is cured and dried during the manufacturing process in embodiments in which base 10 is comprised of cement or adhesive mixtures, may prevent spills and splashes of the contents of base 10 before its contents are dried and cured, and may function as a lid to contain the contents and materials (e.g., loose sand, loose sedimentary rocks, loose metal components, cement, or adhesive mixtures) within base 10.

Figure 6:
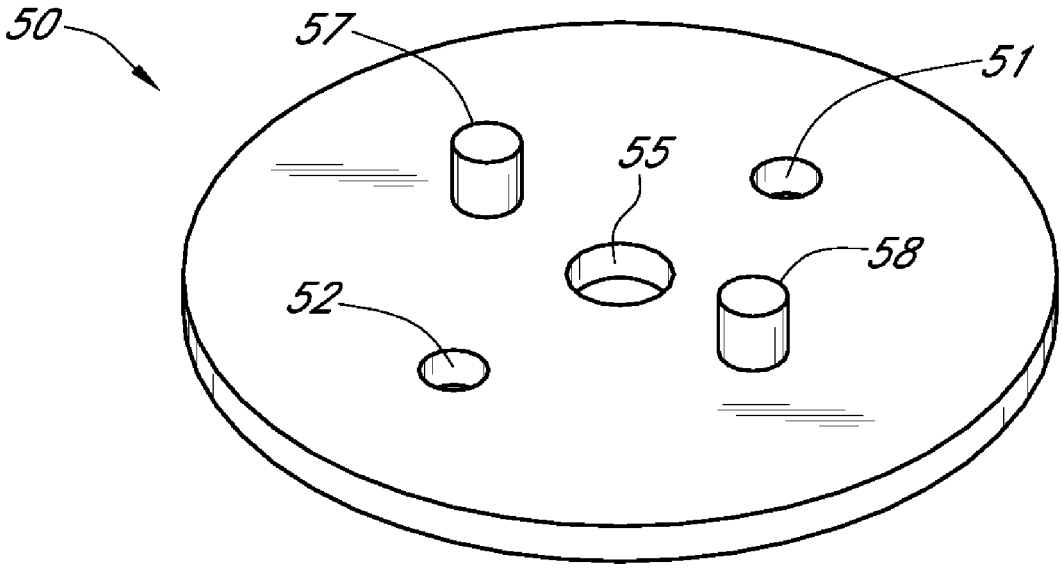
FIG. 6 depicts an upside down perspective view of the platform of the balloon holder shown in FIG. 4 in accordance with an embodiment of the present invention.

FIG. 6 depicts an upside-down perspective view of platform 50 shown in FIGS. 4 and 5. Platform 50 includes a center aperture 55 through which stem 40 passes through and at least one additional aperture through which loop member 30 passes through. Center aperture 55 may be at the center or within the center area of platform 50. As illustrated in FIG. 6, the at least one aperture may be comprised of a first aperture 51 and a second aperture 52 which are positioned on opposite sides of central aperture 55. First end 31 of loop member 30 passes through first aperture 51, and second end 32 of loop member 30 passes through second aperture 52. In an alternate variation of the invention, loop member 30 is configured with a sunken portion 33 that is comprised of only one end. In such embodiments, the at least one additional aperture is comprised of one aperture through which the end of sunken portion 33 passes through. In embodiments of the invention that contain multiple stems that form air-filled balloon bouquets, platform 50 may include a plurality of central apertures through which the multiple stems pass through. The plurality of central apertures do not necessarily need to be positioned within the center or central area of platform 50 but may be positioned in an aesthetically pleasing and evenly-spaced configuration (e.g., symmetric arrangement, staggered arrangement, positioned along the perimeter or circumference of platform 50, etc.).

Platform 50 may naturally adhere to the top of base 10 during the drying and curing process in embodiments wherein base 10 is comprised of cement or an adhesive mixture. Platform 50 may also include one or more downward projections to further anchor and secure platform 50 onto base 10. As illustrated in FIG. 6, platform 50 includes downward projections 57 and 58 that help anchor platform 50 into base 10 and help stabilizes platform 50. In alternate variations of the invention, platform 50 may not include any downward projections, may include only one downward projection, or may include more than two downward projections.

Platform 50 may also be attached to the top of base 10 by any other suitable method. For example, platform 50 is adhered to the top of base 10 by a layer of glue 59 as illustrated in FIG. 4. Yet, in an alternate embodiment of the invention, platform 50 is manufactured as part of housing 20, is positioned parallel to bottom 22 of housing 20, and essentially remains stationary while loop member 30 and stem 40 are inserted through platform 50 and base 10 is filled with its adequately heavy materials such as any suitable cement or adhesive mixtures.

Platform 50 may have any suitable dimensions and shape and is usually shaped according to the interior of housing 20. Platform 50 is surrounded by housing 20 and thus typically takes the shape of a cross-section of housing 20. For instance, in the embodiments of the invention shown in FIGS. 4 and 8, housing 20 is cylindrical in shape with circular cross-sections therein. Thus, platform 50 is circular in the embodiments shown in FIGS. 4 and 8. In embodiments wherein housing 20 is shaped as cube, platform 50 would be shaped as a square, and so forth.

Examples

In the foregoing description of embodiments of the invention, reference was made to the accompanying figures, which form a part of this application. The figures show, by way of illustration, certain embodiments in which the invention may be practiced. It is to be understood that other variations are possible and modifications may be made without departing from the scope of the present invention. A variety of embodiments are possible wherein each embodiment includes a different combination of the different aspects and elements of the present invention.

For example, in one embodiment, a balloon holder for helium and air-filled balloons is comprised of: (a) a base with adequate mass to hold down at least one helium balloon; (b) a housing surrounding the base; (c) a loop member comprised of a sunken portion submerged inside the base and a loop above the base wherein the loop fastens to a line attached to a helium balloon; and (d) a stem comprised of a lower end submerged inside the base and a top end above the base wherein the top end of the stem is adapted to receive a balloon cup that is attached to an air-filled balloon. The balloon cup is removably attachable to the top end to allow the user to interchange the air-filled balloon. In another variation of the invention, the housing is about the same height as the base, and the housing includes a housing top that covers the top of the base and is comprised of a central aperture and at least one additional aperture wherein the stem runs through the central aperture and the loop member runs through the at least one additional aperture.

In another example, an alternate embodiment of the invention may include: In an additional embodiment of the present invention, a balloon holder for helium and air-filled balloons comprises: (a) a base with adequate mass to hold down at least one helium balloon; (b) a housing that is taller than the base and surrounds the base to form a cavity above the base wherein the housing includes an opening above the cavity and a bottom beneath the base; (c) a loop member that includes a sunken portion submerged inside the base and a loop positioned above the base wherein the loop fastens to a line attached to a helium balloon; (d) a stem that includes a lower end submerged inside the base and a top end positioned above the base wherein the top end is adapted to secure an air-filled balloon, and (e) a platform on top of the base. The platform includes a center aperture and at least one additional aperture wherein the stem passes through the center aperture and the loop member passes through the at least one additional aperture. The loop that secures one or more helium balloons and the top end that secures an air-filled balloon are accessible through the housing's opening which is positioned above the cavity. The top end of the stem may further include a balloon cup that attaches directly to an air-filled balloon. This balloon cup is removably attachable to the top end of the stem to allow a user to interchange different air-filled balloons. The base may be comprised of sand or of cement in different variations of the invention. The platform may also include one or more downward projections that anchor the platform onto the base. Additionally, multiple tiers of cascading streamers may be attached to the exterior of the housing such that the loop is recessed within the highest tier of cascading streamers.

In a further example, a balloon holder for helium and air-filled balloons is comprised of: a balloon holder for helium and air-filled balloons comprising: (a) a base with adequate mass to hold down at least one helium balloon; (b) a housing that is taller than the base wherein the housing surrounds the base and forms a cavity above the base, and the housing includes an opening above the cavity and a bottom beneath the base; (c) a wire comprised of a first wire end, a second wire end wherein the first wire end and the second wire end are submerged inside the base and the first wire end and the second wire end are tied together, and a loop positioned within the cavity wherein the loop fastens to a line attached to a helium balloon; (d) a stem comprised of a lower end submerged inside the base and a top end positioned within the cavity wherein the top end is adapted to secure an air-filled balloon and wherein the loop and the top end are accessible through the opening of the housing; and (e) a platform on top of the base. The platform includes a first aperture through which the first wire end passes through, a second aperture through which the second wire end passes through, and a center aperture through which the stem passes through. The top end of the stem may also include a balloon cup that attaches to an air-filled balloon and that removably attaches to the top end. The platform further may include at least one downward projection that anchors the platform onto the base. Additionally, the housing may be cylindrical in shape, and the opening and the bottom of the housing may be circular in shape.

Method of Securing Helium and/or Air-Filled Balloons

With respect to the method of the present invention, the order in which the actions are presented below is not limited to any particular order and does not necessarily imply that they have to be performed or occur in the order presented. It will be understood by those of ordinary skill in the art that the order of these actions can be rearranged and performed in any suitable manner. It further will be understood by those of ordinary skill in the art that some actions may be omitted, added, and/or modified and still fall within the spirit of the invention.

In general, a user would utilize the present invention illustrated in FIG. 4 simply by tying one or more lines attached to one or more helium balloons to loop 35 of loop member 30 and/or by attaching an air-filled balloon to balloon cup 46 (see FIG. 2) and then attaching balloon cup 46 to top end 44 of stem 40. Air-filled balloons are commonly sold with balloon cup 46 already attached to it so the user may not need to attach the air-filled balloon to balloon cup 46 as described above. In such cases, the user would simply display and secure the air-filled balloon by attaching balloon cup 46 (that is already attached to the air-filled balloon) to top end 44 of stem 40. Thus, unlike other balloon holding devices on the market, the present invention is versatile as it allows the user to display and secure: (i) air-filled balloons (see FIG. 9), (ii), helium balloons (see FIG. 10), or (iii) both helium and air-filled balloons at the same time (see FIG. 11).

Accordingly, another aspect of the present invention is directed to a method of securing and displaying helium and air-filled balloons, the method comprising: (a) providing a balloon holding device that includes (i) a base with adequate mass to hold down at least one helium balloon; (ii) a housing surrounding the base; (iii) a loop member comprised of a sunken portion submerged inside the base and a loop above the base; and (iv) a stem comprised of a lower end submerged inside the base and a top end above the base wherein the top end of the stem is adapted to receive a balloon cup that is attached to an air-filled balloon wherein the balloon cup is removably attachable to the top end; (b) tying one or more helium balloon lines to the loop wherein the lines are attached to helium balloons; (c) attaching an air-filled balloon to a balloon cup; and (d) attaching the balloon cup to the top end of the stem.

Figure 11:
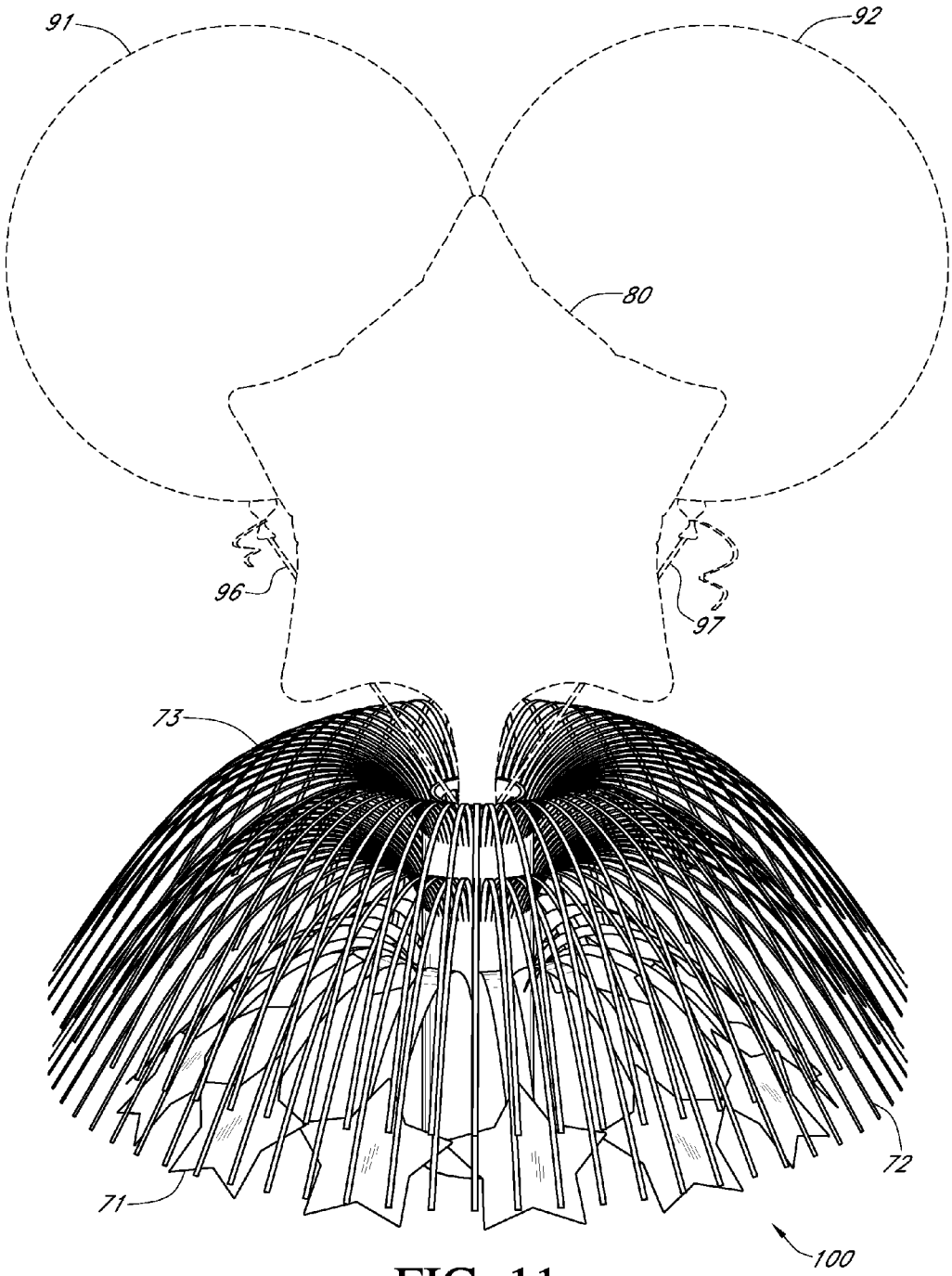
FIG. 11 depicts a perspective view of a balloon holder holding an air-filled balloon and helium balloons in accordance with an embodiment of the present invention.

In the foregoing method of the present invention, the user uses the balloon holding device as described hereinabove. FIG. 11 depicts balloon holder 100 shown in FIG. 1 wherein both helium and air-filled balloons are secured and displayed. Lines 96 and 97 are respectively attached to helium balloons 91 and 92. Referring also to FIG. 2, the user would tie lines 96 and 97 to loop 35 and attach air-filled balloon 80 to balloon cup 46. Since air-filled balloons are often sold with a standard balloon cup already attached to it, step (c) described above may be omitted in some embodiments. Balloon cup 46 (while attached to air-filled balloon 80) is then attached to top end 44 of stem 40 (see also FIG. 4).

Figure 9:
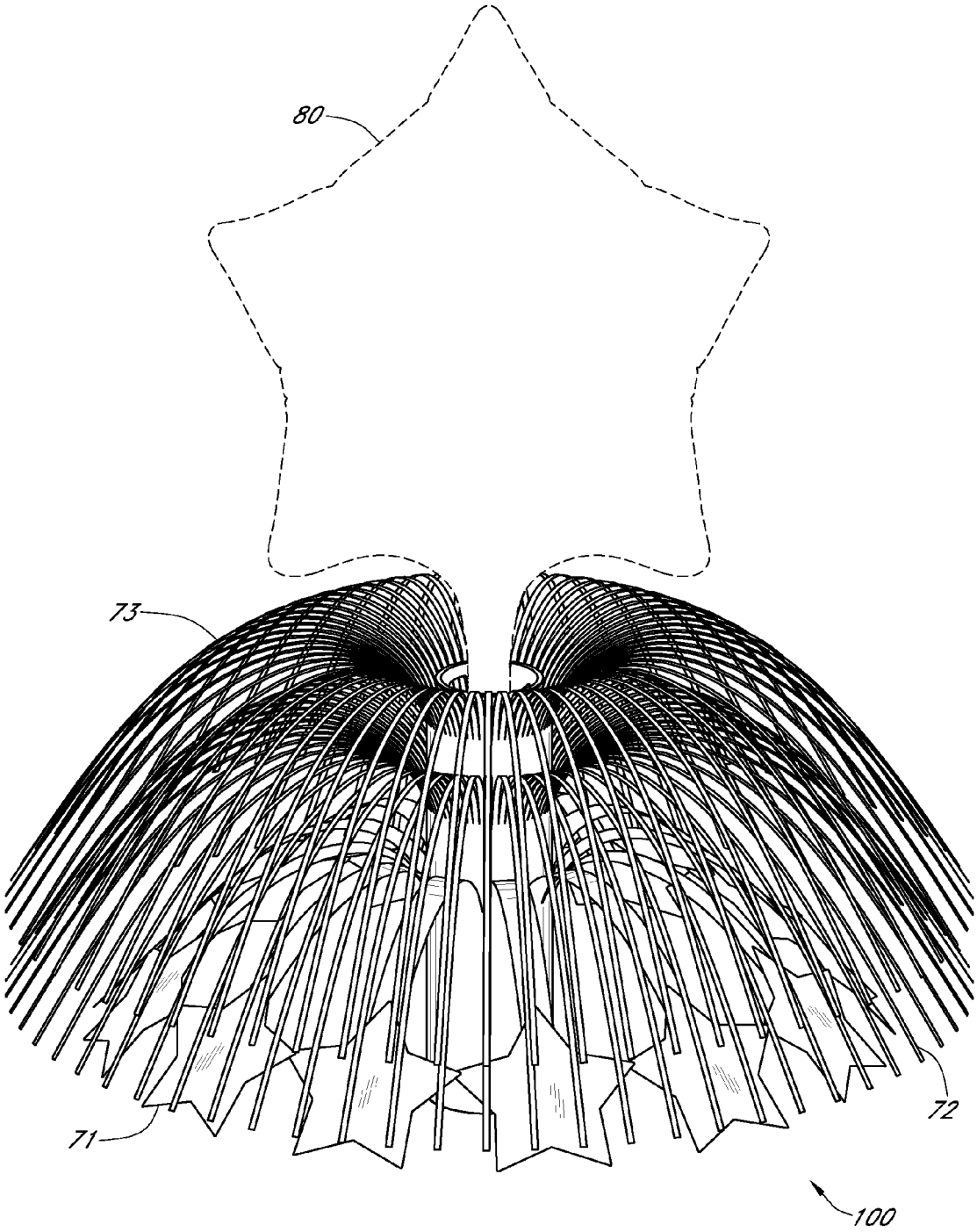
FIG. 9 depicts a perspective view of a balloon holder holding an air-filled balloon in accordance with an embodiment of the present invention.

FIG. 9 depicts balloon holder 100 shown in FIG. 1 wherein only an air-filled balloon is secured and displayed. Thus, the user would omit step (b) described above. Referring also to FIGS. 2 and 4, the user would simply attach air-filled balloon 80 to balloon cup 46 and then attach balloon cup 46 to top end 44 of stem 40 to secure and display air-filled balloon 80.

Figure 10:
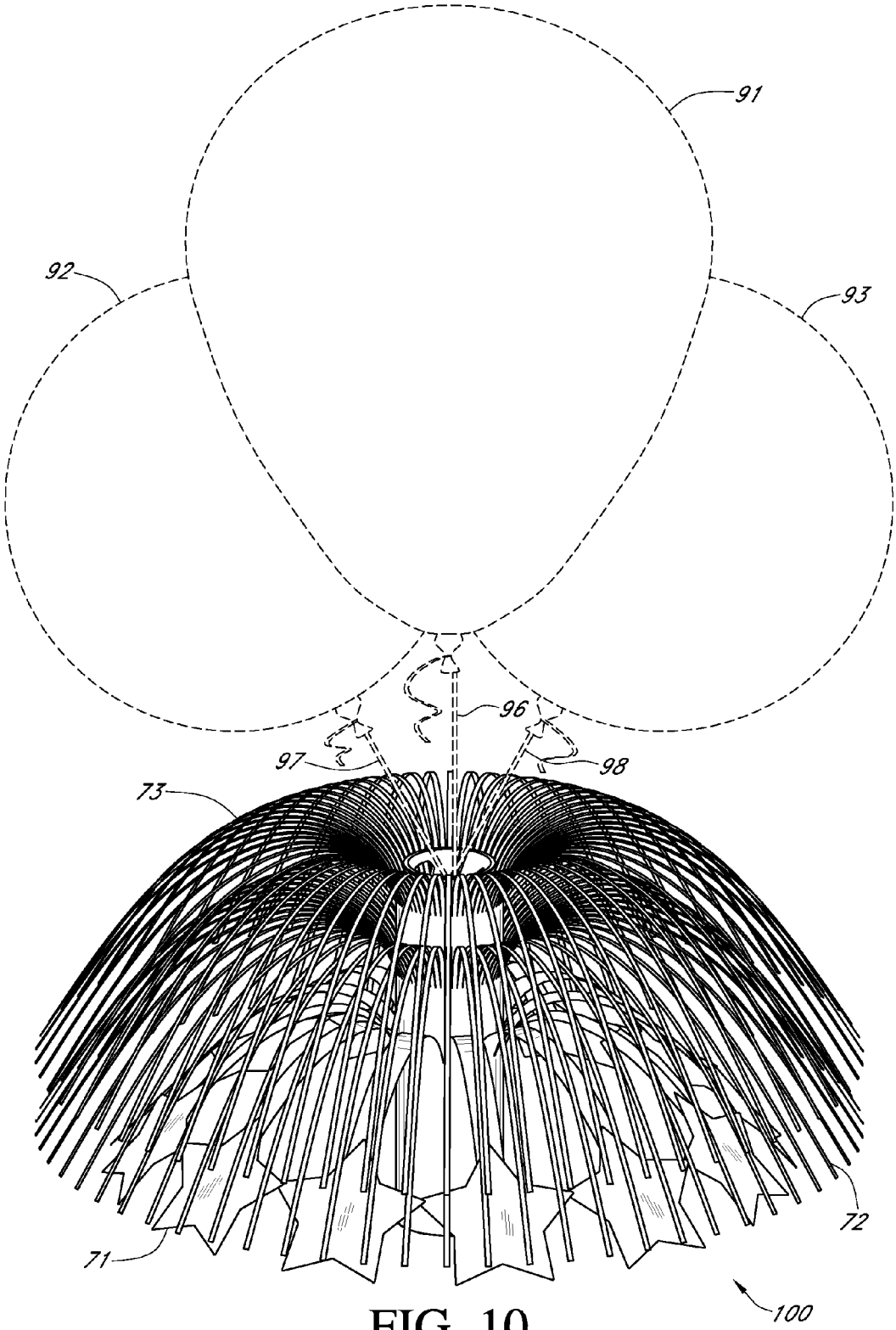
FIG. 10 depicts a perspective view of a balloon holder holding helium balloons in accordance with an embodiment of the present invention.

FIG. 10 depicts balloon holder 100 shown in FIG. 1 wherein only helium balloons (and no air-filled balloons) are secured and displayed. The user would therefore omit steps (c) and (d) described above. Lines 96, 97, and 98 are respectively attached to helium balloons 91, 92, and 93. Referring also to FIGS. 3 and 4, the user would tie lines 96, 97, and 98 to loop 35 to secure and display helium balloons 91, 92, and 93.

Although the present invention has been described above in considerable detail with reference to certain versions thereof, other versions are possible. As discussed above, many of the structural components of the invention (e.g., base, housing, loop member, stem, and platform) may be of any suitable shape, dimension, and/or configuration; may further include structures not described hereinabove; and may be positioned at alternate suitable locations within the device without departing from the spirit and scope of the present invention.

Additionally, some of the actions or steps for displaying and securing helium and air-filled balloons described in the method hereinabove may be added, omitted, modified, or performed in various sequences. Also, some of the actions identified in the embodiments described herein are for illustrative purposes, and as such, some of the actions may be modified, added, or omitted without departing from the scope of the invention.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A balloon holder for helium and air-filled balloons comprising:
- a base with adequate mass to hold down at least one helium balloon;
- a housing surrounding the base;
- a loop member comprised of
  - a sunken portion submerged inside the base and
  - a loop above the base wherein the loop fastens to a line attached to a helium balloon; and
- a stem comprised of
  - a lower end submerged inside the base and
  - a top end above the base wherein the top end is adapted to receive a balloon cup attached to an air-filled balloon wherein the balloon cup is removably attachable to the top end.

2. The balloon holder of claim 1 further comprising a platform on top of the base, the platform comprising a central aperture and at least one additional aperture wherein the stem passes through the central aperture and the loop member passes through the at least one aperture.

3. The balloon holder of claim 2 wherein the housing comprises an opening on top of the housing and the housing is taller than the base thereby forming a cavity above the base wherein the loop and the top end of the stem are accessible through the opening.

4. The balloon holder of claim 1 wherein the loop member is comprised of a wire.

5. The balloon holder of claim 4 wherein the sunken portion of the loop member is comprised of a first end and a second end wherein the first end is attached to the second end.

6. The balloon holder of claim 5 further comprising a platform on top of the base, the platform comprising a central aperture, a first aperture, and a second aperture wherein the stem passes through the central aperture, the first end passes through the first aperture, and the second end passes through the second aperture.

7. The balloon holder of claim 1 wherein the housing comprises a housing top that covers the top of the base wherein the housing top is comprised of a central aperture and at least one additional aperture wherein the stem runs through the central aperture and the loop member runs through the at least one additional aperture.

8. A balloon holder for helium and air-filled balloons comprising:
- a base with adequate mass to hold down at least one helium balloon;
- a housing that is taller than the base wherein the housing surrounds the base and forms a cavity above the base, the housing comprising an opening above the cavity and a bottom beneath the base;
- a loop member comprised of
  - a sunken portion submerged inside the base and
  - a loop positioned above the base wherein the loop fastens to a line attached to a helium balloon;
- a stem comprised of
  - a lower end submerged inside the base and
  - a top end positioned above the base wherein the top end is adapted to secure an air-filled balloon and wherein the loop and the top end are accessible through the opening of the housing; and
- a platform on top of the base, the platform comprising
  - a center aperture and
  - at least one additional aperture wherein the stem passes through the center aperture and the loop member passes through the at least one additional aperture.

9. The balloon holder of claim 8 wherein the top end comprises a balloon cup that attaches to an air-filled balloon wherein the balloon cup is removably attachable to the top end.

10. The balloon holder of claim 8 wherein the loop member is comprised of a metal wire.

11. The balloon holder of claim 10 wherein the sunken portion is comprised of a first end and a second end, and the first end is attached to the second end.

12. The balloon holder of claim 8 wherein the sunken portion is comprised of a first end and a second end and the at least one additional aperture is comprised of a first aperture and a second aperture wherein the first end passes through the first aperture and the second end passes through the second aperture.

13. The balloon holder of claim 8 wherein the base is comprised of sand.

14. The balloon holder of claim 8 wherein the base is comprised of cement.

15. The balloon holder of claim 8 wherein the platform further comprises at least one downward projection that anchors the platform onto the base.

16. The balloon holder of claim 8 wherein multiple tiers of cascading streamers are attached to the exterior of the housing wherein the loop is recessed within the highest tier of the multiple tiers of cascading streamers.

17. A balloon holder for helium and air-filled balloons comprising:

a base with adequate mass to hold down at least one helium balloon;

a housing that is taller than the base wherein the housing surrounds the base and forms a cavity above the base, the housing comprising an opening above the cavity and a bottom beneath the base;

a wire comprised of a first wire end, a second wire end wherein the first wire end and the second wire end are submerged inside the base and the first wire end and the second wire end are tied together, and a loop positioned within the cavity wherein the loop fastens to a line attached to a helium balloon;

a stem comprised of a lower end submerged inside the base and a top end positioned within the cavity wherein the top end is adapted to secure an air-filled balloon and wherein the loop and the top end are accessible through the opening of the housing; and a platform on top of the base, the platform comprising a first aperture, a second aperture, and a center aperture wherein the first wire end passes through the first aperture, the second wire end passes through the second aperture, and the stem passes through the center aperture.

18. The balloon holder of claim 17 wherein the top end comprises a balloon cup that attaches to an air-filled balloon wherein the balloon cup is removably attachable to the top end.

19. The balloon holder of claim 17 wherein the platform further comprises at least one downward projection that anchors the platform onto the base.

20. The balloon holder of claim 17 wherein the housing is cylindrical and the opening and the bottom are circular.

* * * * *